US005338246A

United States Patent [19]

Suto

[11] Patent Number: 5,338,246

[45] Date of Patent: Aug. 16, 1994

[54] SUSPENSION SYSTEMS OF VEHICLE TOYS

[75] Inventor: Shohei Suto, Tokyo, Japan

[73] Assignee: Taiyo Kogyo Co., Ltd., Tokyo, Japan

[21] Appl. No.: 44,375

[22] Filed: Apr. 7, 1993

[30] Foreign Application Priority Data

Jun. 1, 1992 [JP] Japan ..... 4-163391

[51] Int. Cl.[5] ..... A63H 17/26; A63H 17/36

[52] U.S. Cl. ..... 446/466; 446/468; 280/696; 280/666

[58] Field of Search ..... 446/466, 468, 460, 469; 280/666, 667, 670, 691, 696, 673

[56] References Cited

U.S. PATENT DOCUMENTS 2,117,588 5/1938 Armstrong ..... 280/696 X
3,144,731 8/1964 Jones et al. ..... 446/466
4,763,920 8/1988 Huidekoper ..... 280/696 X

FOREIGN PATENT DOCUMENTS 553934 1/1957 Italy ..... 280/667

*Primary Examiner*—Mickey Yu
*Attorney, Agent, or Firm*—Bartlett & Sherer

[57] ABSTRACT

Suspension systems (10; 42; 8) operate independently of each other on opposite sides of a vehicle toy. The systems have their road wheels move up and down substantially without any inclination of these wheels, and are simple in construction. Each suspension system has an upright member (16) on which the wheel axle (13) is fixedly mounted, an upright holder (18) for holding the upright member (16) so as to permit it to be rotatable in a steering operation, a rod (22) having its lower portion fixedly mounted to the holder (18) and its upper portion guided in a guide (24) formed in an upper portion of the body, and a compression spring (26) interposed between the holder (18) and the guide (24). A swing arm (20) has one end pivotally connected to the body and the other end pivotally connected to the holder (18). The upright member (16) and the upright holder (18) may be integrally formed as a support (82) rotatably mounted on the lower portion of the rod.

18 Claims, 9 Drawing Sheets

FIG. 7
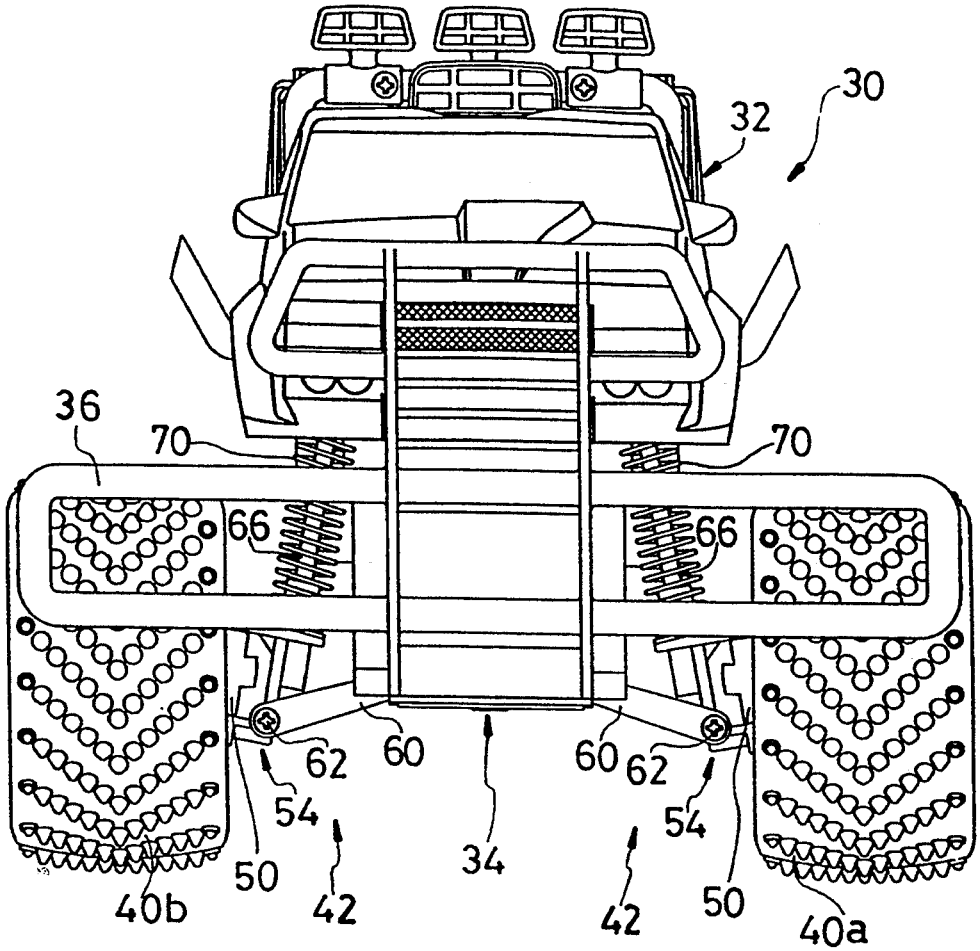
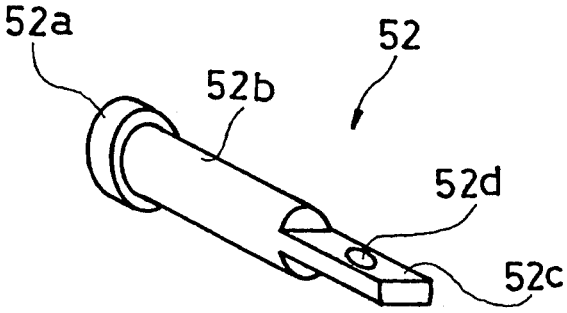
FIG. 8

SUSPENSION SYSTEMS OF VEHICLE TOYS

BACKGROUND OF THE INVENTION

1. Field of the Invention

The present invention relates to vehicle toys and their suspension systems, particularly the suspension of steerable road wheels.

2. Description of the Prior Art

In general, since vehicle toys are subjected to the influence of a rough road surface in travelling, some of the vehicle toys are provided with a suspension system for connecting a body of the vehicle toy with wheel axles thereof through springs, links and shock absorbers so as to absorb road shocks. In this way, the vehicle toy itself is protected from road shocks which are also damped to improve the vehicle toy in roadability. Heretofore, the suspension system employed in the vehicle toy has been, for example, a swing-arm type, a double-wishbone type, a rigid-axle type, or the like.

As shown in FIG. 11 of the accompanying drawings, a suspension system 100 of a swing-arm type is an independent mechanism provided in each of opposite sides of the vehicle toy. In this system 100, a swing arm 104 has one end pivotally connected with a chassis 102, and rotatably supports at its other end an upright member 108. A steerable wheel 106 is mounted on the upright member 108 through a wheel axle 105. A spring 109 is interposed between an upper portion of the chassis 102 and the other end of the swing arm 104. Although the suspension system 100 of this swing-arm type is simple in construction, the system 100 is disadvantageous in that an inclination of the wheel 106 to the vertical becomes large when the swing arm 104 moves up and down.

As shown in FIG. 12 of the accompanying drawings, a suspension system 110 of the double-wishbone type is an independent mechanism provided on each of opposite sides of the vehicle toy. In the system 110, each of a pair of swing arms 112, 112 has one end pivotally connected with the chassis 102, and pivotally supports at its other end an upright holder 114. Supported by this upright holder 114 is an upright rotatable member 116 to which a wheel 106 is rotatably mounted. A compression spring 118 is interposed between an upper portion of the chassis 102 and the upright holder 114. In this double-wishbone type suspension system, there is no inclination of the wheel 106 when the pair of the swing arms 112 move up and down. However, in construction, this system is complex, which leads to a high cost thereof which is a disadvantage of this system.

As shown in FIG. 13 of the accompanying drawings, in a suspension system 120 of the rigid-axle type, a connecting axle 122 connects left and right wheels 106, 106, and rotatably supports at its opposite end portions a pair of upright members 124, 124. Mounted on these upright members 124, 124, through a pair of axles 105, 105, are the left and right wheels 106, 106. A pair of compression springs 126, 126 are interposed between an upper portion of the chassis 102 and the opposite end portions of the wheel axle 122. In this rigid-axle type suspension system, there is no inclination of the left and the right wheel 106, 106 when the wheel axle 122 moves up and down. However, since the left and right wheels 106, 106 move up and down as a whole at the same time, the suspension system does not function properly and is disadvantageous when the vehicle toy is subjected to an inclining force produced during cornering of the vehicle toy, which inclining force causes the vehicle toy when of a high-speed type and an off-road type to tend to overturn.

SUMMARY OF THE INVENTION

It is an object of the present invention to provide an improved vehicle toy suspension system for independent suspension of steerable wheels.

It is a further object of preferred embodiments of the present invention to provide a vehicle toy with a wheel suspension system which can function independently on either side of the vehicle toy, produce no or very little inclination of the wheel when the vehicle toy moves up and down, and is fairly simple in construction.

According to the present invention, there is provided in a suspension system of a vehicle toy for connecting a body to a wheel axle (on which a wheel is mounted) independently on each of opposite sides of the body, the improvement comprising an upright member on which the axle is fixedly mounted, an upright holder for holding the upright member so as to permit it to rotate in steering operation, a rod which has a lower portion fixedly mounted on the upright holder and has an upper portion guided in a guide formed in an upper-portion side of the body, a compression spring interposed between the upright holder and the guide, and a swing arm which has one end swingably connected to the body and its other end swingably connected to the upright holder.

The upright member may be rotatably supported by the upright holder through a king pin which has its upper end inclining towards a center of the body.

According to another aspect of the present invention, there is provided in a suspension system of a vehicle toy for connecting a body to a wheel axle (on which a wheel is mounted) independently on either of opposite sides of the body, the improvement comprising a wheel supporting portion on which the wheel axle is fixedly mounted, a rod which holds at a lower end the wheel supporting portion so as to permit the wheel supporting portion to be rotatable in a steering operation, the rod having an upper end guided in a guide which may be formed in an upper side portion of the body, a compression spring interposed between the wheel supporting portion and the guide, and a swing arm which has one end pivotally connected to the body and has its other end pivotally connected to a lower end of the rod.

In the suspension system of the present invention, since the motion of the upright member is limited by both (i) a circular path of an end portion of the swing arm as the swing arm pivots up and down, and (ii) the guide which guides the upper end of the rod, the wheel mounted on the upright member may move up and down without any, or any substantial, inclination.

Further, when the upright member is rotatably mounted in the upright holder through a king pin having its upper end inclined towards the center of the body, it is possible to move the center of circular steering motion of the wheel in the steering operation I to a location near a center of the wheel. This makes assembly of the vehicle toy easier, and also improves the straight-ahead travelling properties of the vehicle toy.

Further, in a particular embodiment of the suspension system of the present invention, since the motion of the wheel supporting portion is limited by both of a circular path of an end portion of the swing arm being pivoted, and the guide which guides an upper-portion of the rod through a side portion of the body, the wheel supported by the wheel supporting portion may move up and down without any inclination. In addition, since the wheel supporting portion and the upright holder may form an integral entity in construction, the suspension system can be made relatively easy in construction and assembling thereof.

According to yet another aspect of the present invention, there is provided a steerable vehicle toy comprising a body having a wall portion, a guide in said wall portion, a steerable road wheel mounted on an axle, an upwardly extending rod having an upper portion slidably guided in the guide, a rotatable connection between a lower portion of the rod and the axle to permit steering rotation of the axle relative to the body during a steering operation, a spring biassing the rod downwardly through the guide, and a swing arm having two ends, one end being pivotally connected to the body, and the other end being pivotally connected to the lower portion of the rod.

Preferably, the rod is upwardly and inwardly inclined with respect to the body, and in conjunction with the swing arm confines the wheel to move upwardly and downwardly relative to the body without inclining of the wheel.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings:

FIG. 7 is a front view of the vehicle toy of FIG. 1;

FIG. 8 is a perspective view of a wheel axle of the embodiment of FIG. 1;

DETAILED DESCRIPTION OF THE PREFERRED EMBODIMENTS

The preferred embodiments of the present invention are shown in FIGS. 1 to 10.

Figure 1:
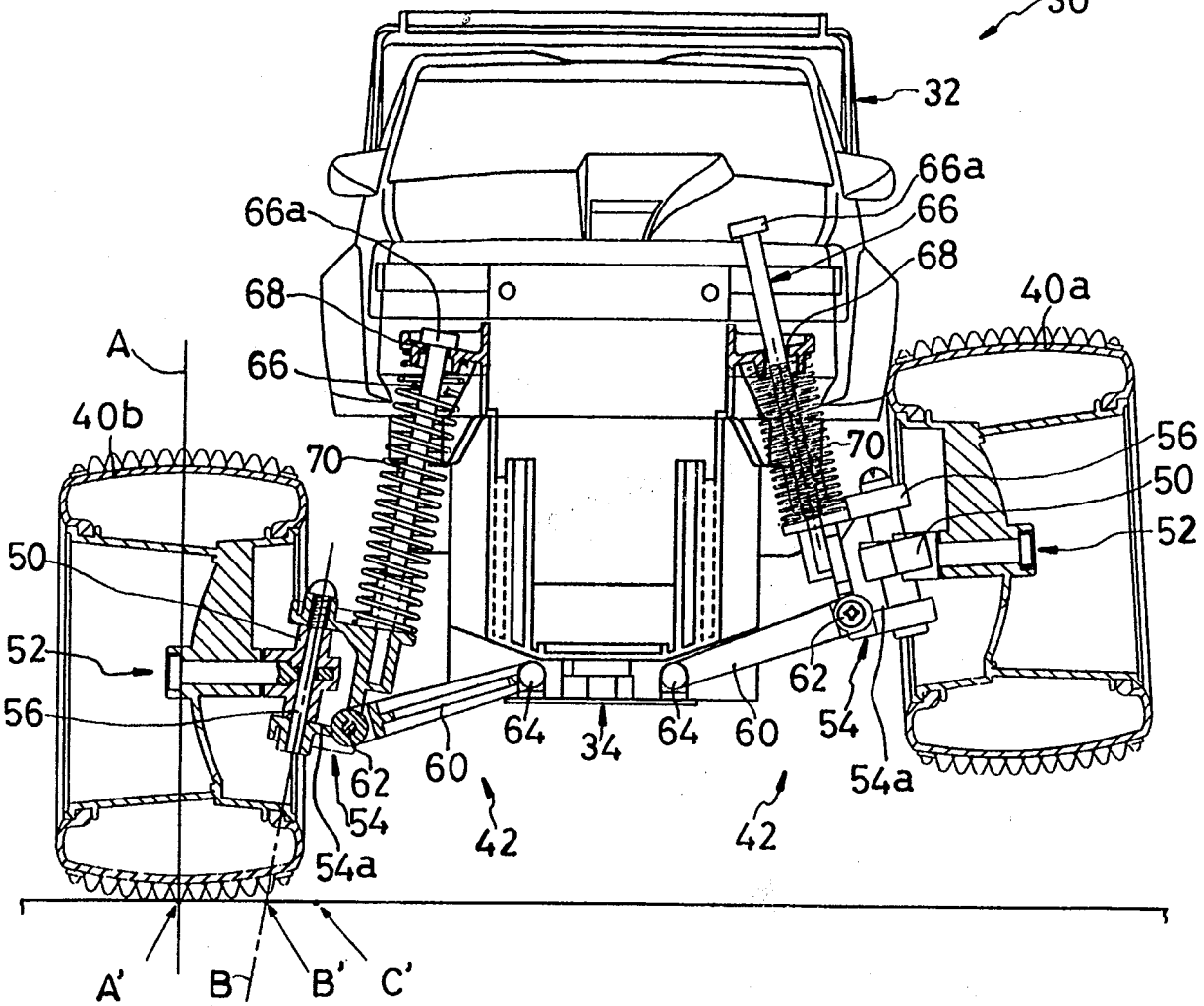
FIG. 1 is a front view of a vehicle toy, illustrating the suspension system of an embodiment of the present invention, a part of the suspension system being broken away and shown in section.
Figure 2:
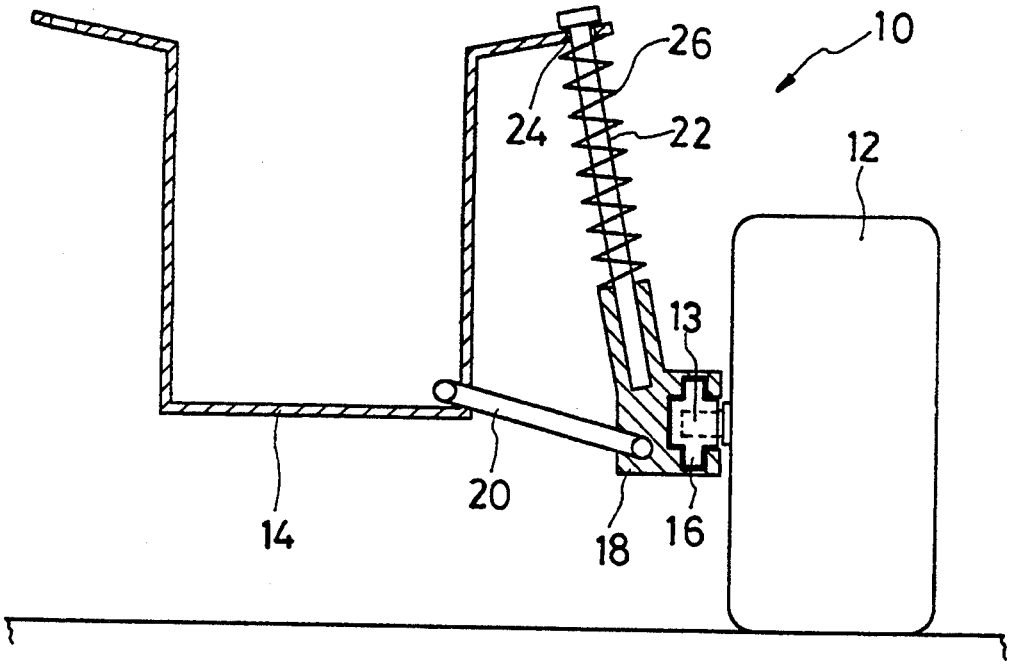
FIG. 2 is a partial front view mostly in section illustrating a simplified version of the suspension system of the vehicle toy of the present invention.
Figure 3:
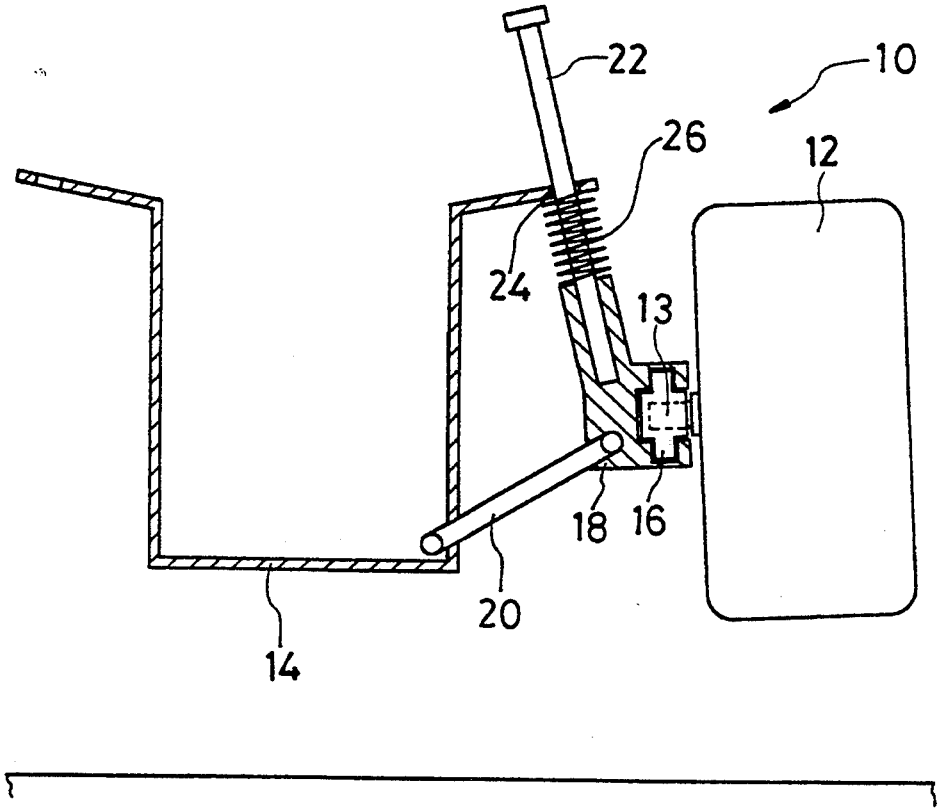
FIG. 3 is a similar view to FIG. 2 illustrating a condition in which the wheel of the suspension system moves upwardly relative to the body of the vehicle toy.
Figure 4:
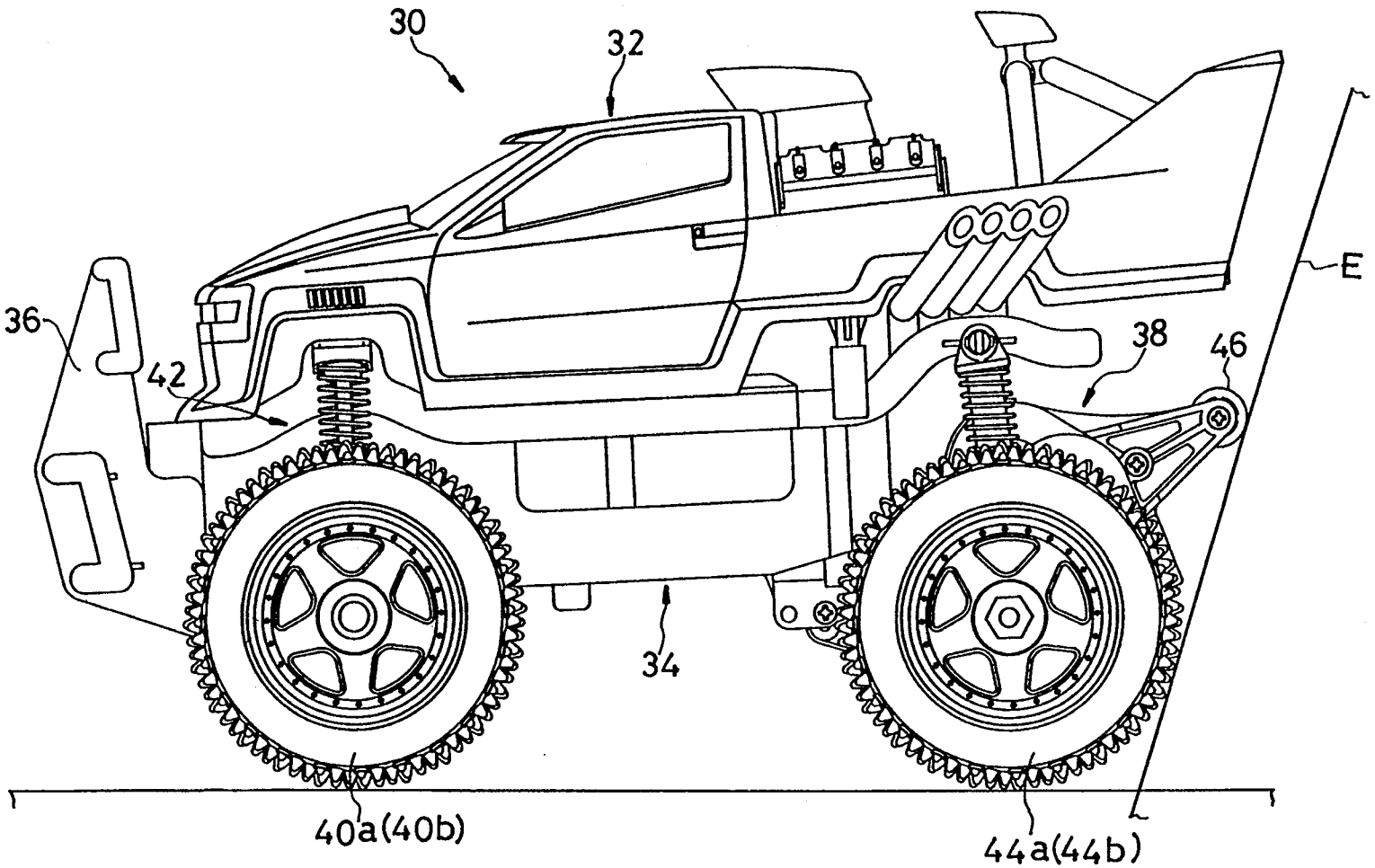
FIG. 4 is a side view of the vehicle toy of FIG. 1.
Figure 5:
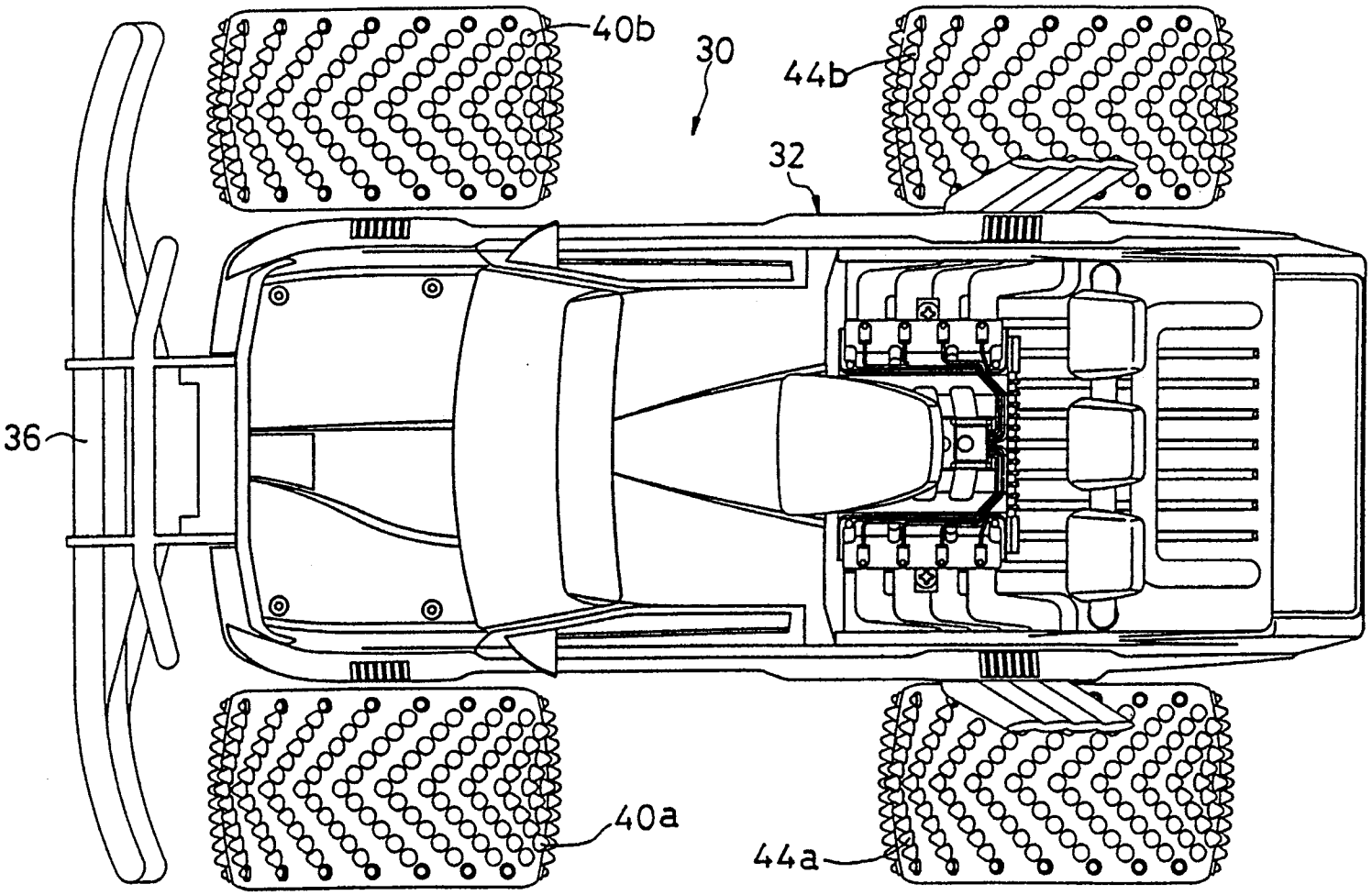
FIG. 5 is a plan view of the vehicle toy of FIG. 1.
Figure 6:
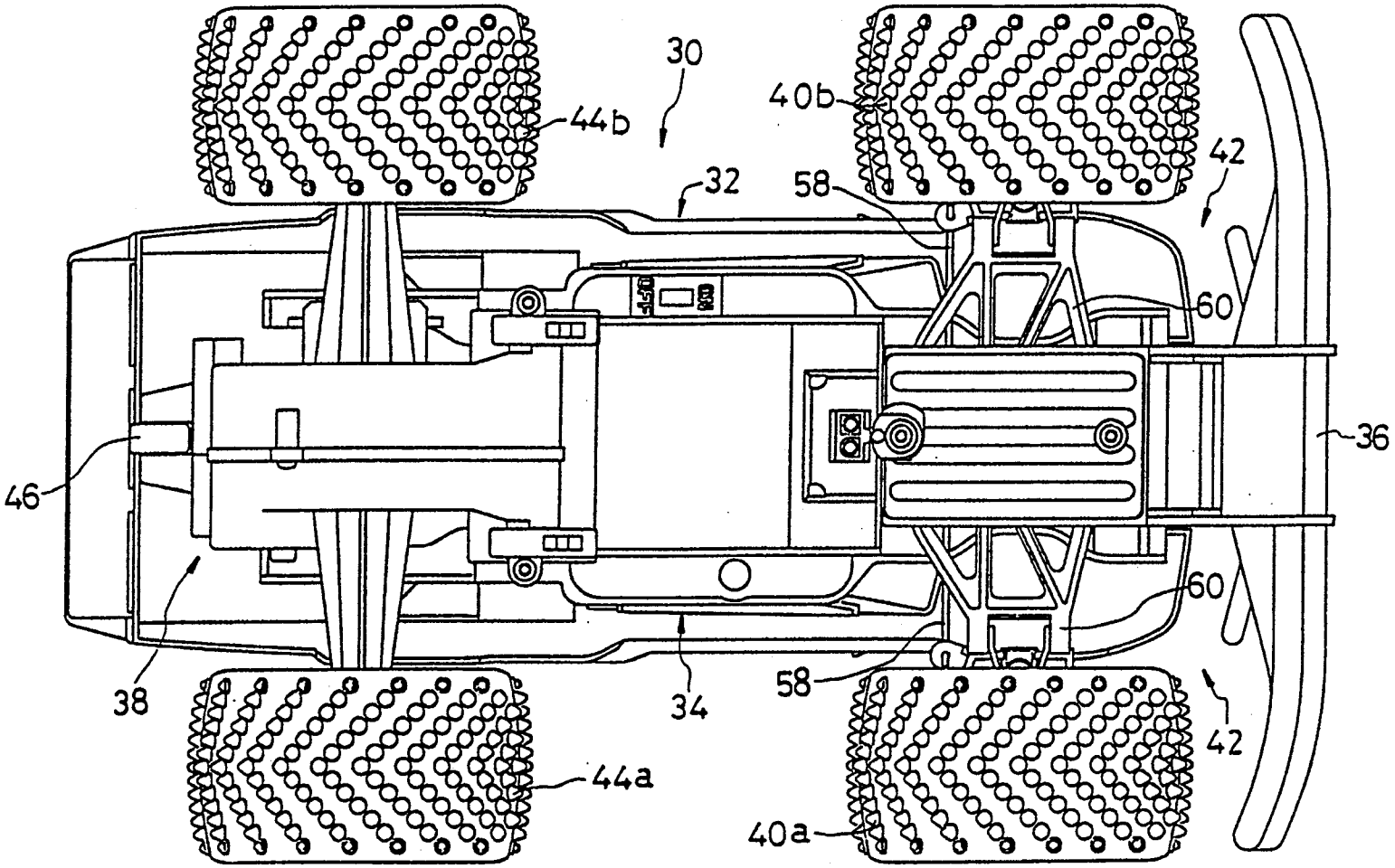
FIG. 6 is a bottom view of the vehicle toy of FIG. 1.

The present invention will first be described with reference to the embodiment shown in FIGS. 2 and 3. FIG. 2 is a view illustrating in construction a suspension system of a vehicle toy of the present invention. FIG. 3 is a view illustrating a condition in which a wheel of the suspension system shown in FIG. 2 moves up. Incidentally, only one side of the suspension system will be described, the other side being the same but a mirror image.

As shown in FIGS. 2 and 3, a suspension system 10 of a vehicle toy of the present invention is provided with mechanisms which operate independently of each other on opposite sides of the vehicle toy, each mechanism connecting a wheel axle 13 to a chassis or body 14. The wheel axle 13, on which the wheel 12 is rotatably mounted, is fixedly mounted in an upright member 16 which is rotatably mounted in an upright holder 18. Pivotally connecting this upright holder 18 and a lower portion of the body 14 is a swing arm 20. Fixedly mounted on an upper portion of the upright holder 18 is a lower end portion of a rod 22 which has its upper end portion guided by a guide 24, such as a hole or the like, formed in an upper side portion of the body 14. Mounted on and encircling this rod 22, between the upright holder 18 and the guide 24, is a compression spring 26 which exerts its resilient force so as to bias the upright holder 18 away from the guide 24.

In this suspension system 10, since the upright holder 18 is pivotally connected to the body 14 through the swing arm 20, and the lower end portion of the rod 22, fixedly mounted to an upper part of the upright holder 18, is guided by the guide 24 formed in the upper portion of the chassis 14, the upright holder 18 is limited in motion by both (i) a circular path of an end of the swing arm 20 as the swing arm pivots and (ii) the guide 24 guiding the upper portion of the rod 22. Consequently, the wheel 12 mounted on the upright member 16 held by the upright holder 18 may move up and down substantially without any inclination.

Now, a vehicle toy according to the invention and provided with a suspension system having the above construction will be described in greater detail with reference to FIG. 1 and FIGS. 4 to 8.

In FIGS. 1 and 4 to 8, the vehicle toy 30 of this embodiment of the present invention is a truck toy which can be remote-controlled through a radio control. The truck 30 is provided with an upper body 32 forming a top side of the vehicle body and molded of plastics or the like, and a lower body forming a chassis 34 supporting the upper body 32 disposed thereon, the chassis 34 forming a bottom side of the vehicle body. These upper and lower bodies 32, 34 as a whole are formed into a predetermined shape imitating a truck and like vehicles being large in height. Provided in the interior of the vehicle toy are a printed circuit board having a receiver circuit for the radio control, and a battery as an electric power source supplying an electric current to the receiver circuit and a motor of the vehicle toy. A bumper 36 is provided at the front of the chassis 34 and a drive unit 38 is mounted at the rear of the chassis 34, the drive unit 38 being provided with a drive motor and a transmission mechanism. Right and left front steerable wheels **40*b*, 40*a* are connected to the front of the chassis 34 through a suspension system 42 which operates independently on opposite sides of the vehicle toy. Left and right rear wheels 44*a*, 44*b* are mounted on opposite ends of a drive axle of the drive unit 38. The left and right front wheels 40(*a*), 40(*b*) and the left and right rear wheels 44**(*a*), 44(*b*) are all so formed as to have the same diameter, and are provided with a tread pattern in their outer peripheral portions, the tread pattern having a plurality of small projecting portions. A small wheel 46 is provided in a central portion of the rear side of the drive unit 38. The small wheel 46 can be brought into contact with the ground surface (i.e. that shown in FIG. 4 by a solid line E) together with the left and right rear wheels 44*a*, 44*b* in a condition in which the forward end of the vehicle toy 30 is lifted way off the ground during travelling.

The suspension system 42 described above is provided with mechanisms which operate independently of each other on opposite sides of the vehicle toy, each mechanism connects the left or the right front wheel 40*a*, 40*b* to the body 34. Each front wheel 40*a*, 40*b* is rotatably mounted on a wheel axle 52 which is fixedly mounted on an upright member 50 which is rotatably supported by an upright holder 54.

As shown in FIG. 8, the wheel axle 52 is provided with a head portion 52*a* for preventing the wheel from dropping off, an axle portion 52*b* for rotatably mounting the wheel thereon, an inner end formed into a plate-like portion 52*c* having upper and lower flat surfaces, and a through-hole 52*d* in a central portion of this plate-like portion 52*c*.

The upright member 50 is inserted inside a mounting portion 54*a* of the upright holder 54, which portion 54*a* forms a channel-like shape in section. The upright member 50 is rotatably mounted on a king pin 56 provided through such inserted portion. This king pin 56 is disposed inside (toward the vehicle body) a center line A of each of the left and right front wheels 40*a*, 40*b*; the king pin is lined up with a line (i.e. a king pin axis B) which at its upper end is slightly inclined to a center of the vehicle body; and, the king pin penetrates the mounting portion 54*a* of the upright holder 54, the upright member 50, and the through-hole 52*d* of the inner end of the wheel axle 52. The king pin axis B intersects with the ground surface at a point B'. A point A' (at which the center line A of each of the left and right front wheels 40*a*,*b* intersects with the ground surface) is closer to the point B' than to a point C' outside (toward the vehicle body) each of the left and right front wheels 40*a*, 40*b*. A lower end portion of this upright member 50 is connected to an outer end of a steering rod 58 (see FIG. 6).

A swing arm 60 connects the upright holder 54 and a lower portion of the chassis 34 pivotally. Namely, the swing arm 60 has one end pivotally connected to a pin 62 provided in a lower portion of the upright holder 54, and has its other end pivotally connected to a supporting portion 64 provided in a lower part of the chassis 34. Fixedly mounted to an upper portion of the upright holder 54 is a lower end portion of a rod 66, a head 66*a* being formed on the upper end of the rod 66. The rod 66 is inserted freely through a hole 68 formed in an upper side wall of the lower body 34 with the head 66*a* above the hole 68. This hole 68 functions as a guide. A compression spring 70 is mounted on the rod 66 between the upright holder 54 and the lower body 34, and exerts a resilient force on both the upright holder 54 and the chassis 34 so as to separate them from each other. In a condition in which the compression spring 70 is expanded to its maximum limit, the head portion 66*a* of the rod 66 abuts on a portion (in which the hole 68 is formed) of the chassis 34 to prevent the spring 70 from being further expanded beyond its limit.

In the suspension system 42 of the vehicle toy 30 having the above construction, since the upright holder 54 is rotatably connected to the lower portion of the chassis 34 through the swing arm 60, and the upper end portion of the rod 66 is guided through the hole 68, the motion of the upright holder 54 is limited by (i) the circular path of the outer end of the swing arm 60, and (ii) the guiding of the rod in and through the hole 68. Consequently, the front wheels 40*a*, 40*b* can move up and down without any inclination.

Heretofore, it has been considered ideal for the center of circular motion (i.e. directional turning) of a road wheel in a steering operation to be close to a center of the wheel, i.e. close to the point A' on the ground surface. For this it is necessary for the king pin to be provided in the interior of the wheel. However, this makes the construction and assembling of the vehicle toy difficult. In order to solve this problem, it is necessary in practice to dispose the axis of the king pin in a location apart from the wheel. However, in the suspension system 42 of the present embodiment, since the axis B of the king pin 56 is so inclined as to have its upper end inclined towards the center of the vehicle body, it is possible to dispose the point B' (at which the axis B, forming a center of the circular motion of each of the front wheel 40*a*, 40*b*, intersects with the ground surface) in a position closer to the point A' (at which the center line A of each of the left and right front wheels intersects with the ground surface) in comparison with the point C' disposed outside (toward the vehicle body) each of the left and right front wheels. In addition, it is also possible to dispose each of the upright member 50, the upright holder 54, and the king pin 56 at a location (toward the vehicle body) slightly apart from each of the left and right wheels 40*b*, 40*b*, which makes the assembling work of the vehicle toy easier. Further, due to the inclination of the axis B of the king pin 56, during a steering operation, each of the front wheels moves down as viewed from a side-surface side of this mechanism. As a result, a force (which urges each of the front wheels to return to its straight-ahead position at which each of the front wheels 40*a*, 40*b* assumes its highest position) acts on each of the front wheels 40*a*, 40*b* to improve the vehicle toy in its properties of straight-ahead travelling.

Figure 9:
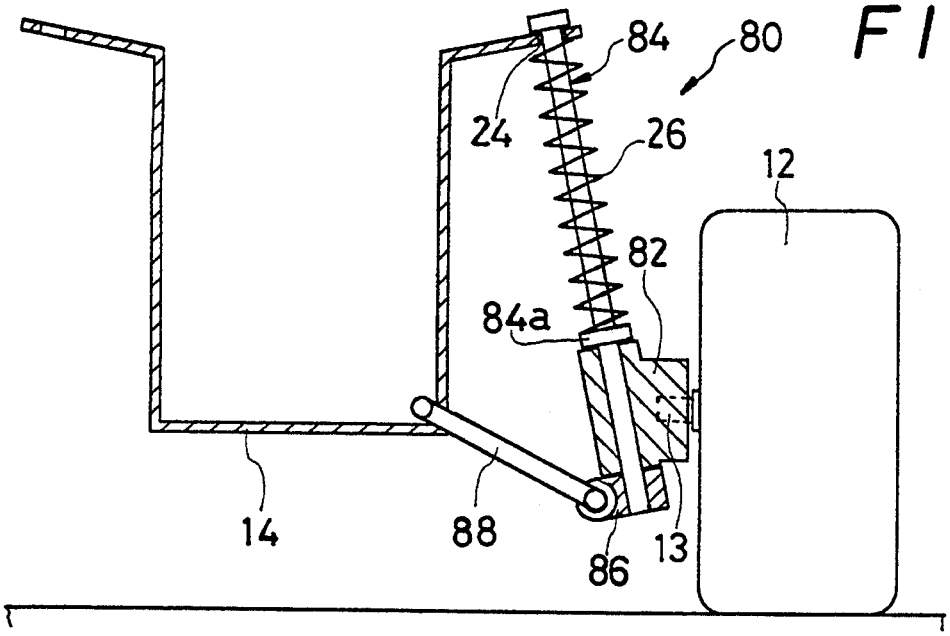
FIG. 9 is a partial front view mostly in section illustrating the construction of the suspension system of a vehicle toy of a further embodiment of the present invention.
Figure 10:
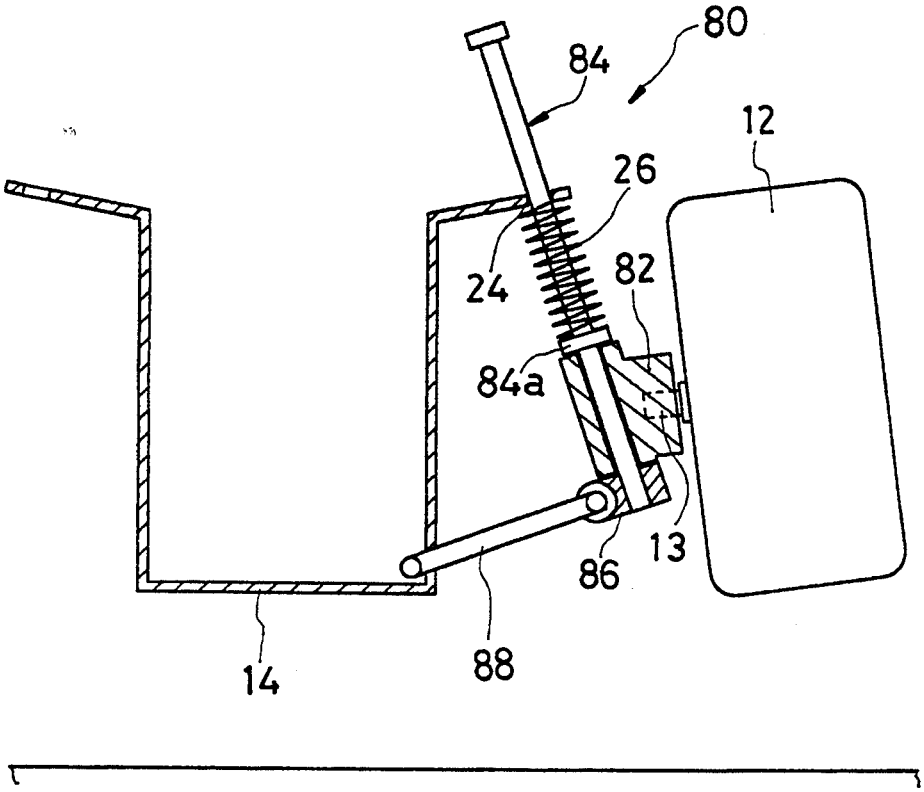
FIG. 10 is a view illustrating a condition in which the wheel of the suspension system shown in FIG. 9 is lifted.
Figure 11:
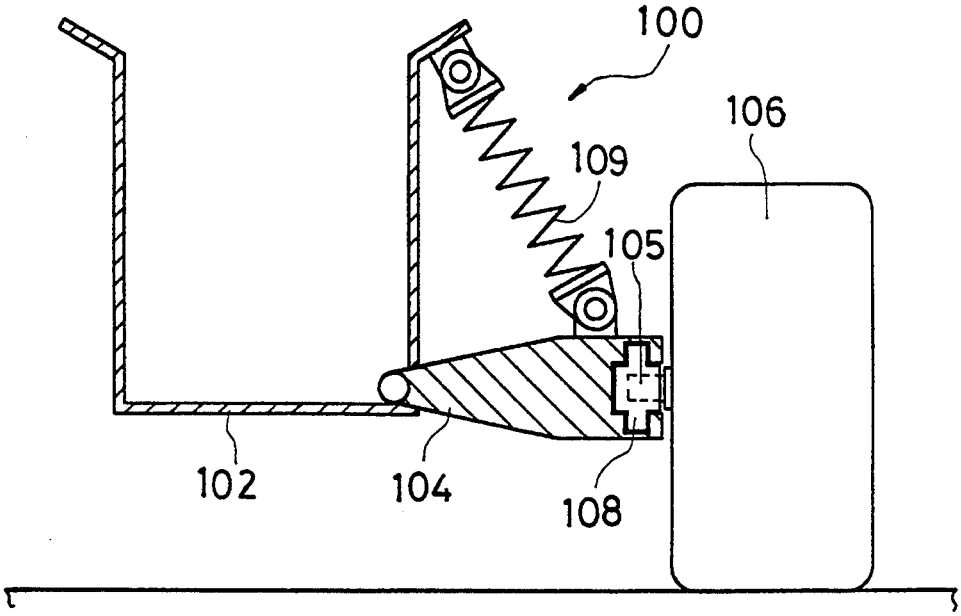
FIG. 11 PRIOR ART
FIG. 11 is a view illustrating the suspension system of the conventional swing-arm type.
Figure 12:
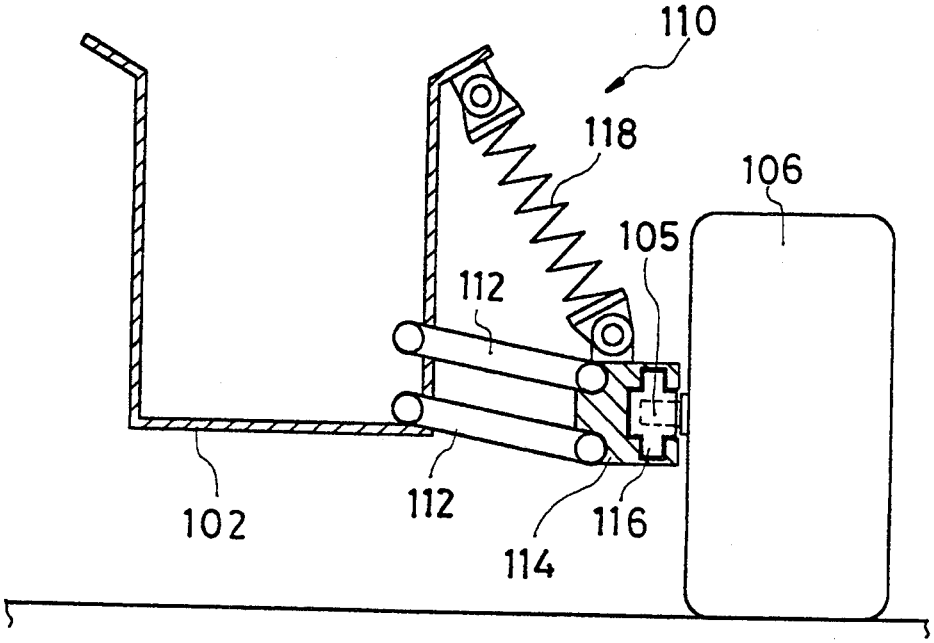
FIG. 12 PRIOR ART
FIG. 12 is a view illustrating the suspension system of the conventional double-wishbone type.
Figure 13:
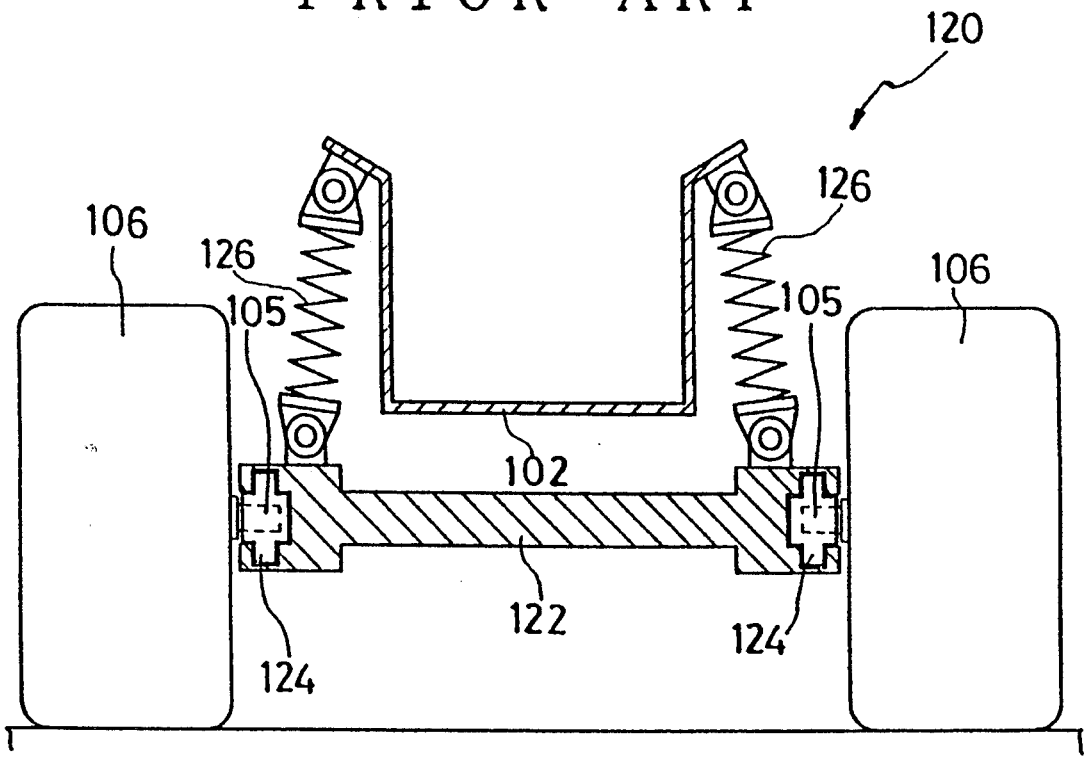
FIG. 13 PRIOR ART
FIG. 13 is a view illustrating the suspension system of the conventional rigid-axle type.

FIGS. 9 and 10 illustrate a construction of a suspension system of another embodiment of the present invention. FIG. 10 is a view illustrating a condition in which a wheel of the suspension system shown in FIG. 9 moves up. This suspension system will be described as to only one side, the other side being the same. Parts of the suspension system corresponding to the parts shown in FIGS. 2 and 3 are denoted by the same reference numerals as those used in FIGS. 2 and 3.

In FIGS. 9 and 10, a suspension system 80 of the vehicle toy of this embodiment is provided with mechanisms which operate independently of each other on opposite sides of the vehicle toy, and each of which mechanisms connects the wheel axle 13, on which the wheel 12 is rotatably mounted, to the chassis or lower body 14. The wheel axle 13 is fixedly mounted on a wheel support 82 which is rotatably mounted on a lower end portion of a rod 84. The wheel support 82 is rotatably mounted on the rod 84 between a shoulder 84*a* (which is formed partway along the rod 84) and a stop 86 fixedly mounted on the lower end of the rod 84. This stop 86 is pivotally connected to the chassis 14 through a swing arm 88. In addition, the upper end of the rod 84 is guided by a guide 24 which may be formed by a hole or the like located in an upper side wall portion of the chassis 14. Mounted and compressed between the shoulder 84*a* of this rod 22 and the guide 24 is a compression spring 26 urging the wheel support 82 downwardly away from the guide 24.

In this suspension system 80, as is in the case of the previously described suspension systems 10 and 42, the wheel support 82 is limited in motion by a circular path of the outer end of the swing arm 88 in conjunction with the rod 84 being guided through the guide 24. Consequently, the wheel 12 can move up and down substantially without any inclination. In addition, in this embodiment, since the wheel support 82 is an integral part replacing the upright member and the upright holder of the previous embodiment, the vehicle toy of this embodiment is simpler in construction and easier in assembling.

Incidentally, in the embodiments described above, the suspension systems 10, 42, 80 are described as applied to front wheels. However, it is also possible to provide each of the rear wheels with any of the suspension systems 10, 42, 80. Further, the guide 24 is so described as to be the hole through which the rod passes, the hole being formed in the upper portion of the chassis 14. However, the guide 24 may assume any form or construction, e.g. a collar, sleeve, rockable member, or the like, provided that it is positioned in the vehicle body to guide the upper portion of the rods 22, 66, 84.

It is possible to apply the suspension system of the present embodiments to any travelling toy having a desired construction. Therefore, it goes without saying that the suspension system of the present invention is applicable to any types of vehicle toys.

It will be appreciated with the above described embodiments that suspension mechanisms are provided on both sides of the vehicle toy and operate independently of each other. These suspension mechanisms may be at the front and/or the back of the vehicle toy.

It will also be appreciated in the above described embodiments, that by having a rotatable connection between a lower portion of the rod and the wheel axle to permit steering rotation of the axle relative to the body during a steering operation, in conjunction with a pivotal connection between the swing arm and the lower portion of the rod, together with the inclination of the rod and the sliding movement of the upper portion of the rod through the guide in the body, the geometry of the movement of the wheel axle can be controlled to prevent, or substantially prevent, inclination of the wheel while it moves up and down relative to the body.

The above described embodiments, of course, are not to be construed as limiting the breadth of the present invention. Modifications, and other alternative constructions, will be apparent which are within the spirit and scope of the invention as defined in the appended claims.

What is claimed is:

1. A steerable vehicle toy, comprising:

a body having a wall portion;

a guide hole in said wall portion;

a steerable wheel mounted on an axle;

an upright member on which said axle is fixedly mounted;

an upright holder disposed below said guide and rotatably supporting said upright member to permit rotation of said upright member during a steering operation;

an upwardly extending rod having a lower portion fixedly mounted to said upright holder;

said rod having an upper portion movably guided in said guide hole;

a spring acting upon said upright holder to bias said upright holder downwardly away form said guide; and a single swing arm having two ends, one end being pivotally connected to said body, and the other end being pivotally connected to said upright holder;

said wheel being guided by said rod and said single swing arm for upward movement with substantially no inclination.

2. The vehicle toy of claim 1, wherein:

said upright holder rotatably supports said upright member by means of a king pin; and said king pin is inclined upwardly and inwardly with respect to said body.

3. The vehicle toy of claim 1, wherein said rod is upwardly and inwardly inclined with respect to said body.

4. The vehicle toy of claim 1 wherein said rod extends upwardly through said guide hole and terminates in an enlarged head above said guide.

5. The vehicle toy of claim 1, wherein said spring comprises a compression spring interposed between said upright holder and said guide wall.

6. The vehicle toy of claim 1, wherein said rod is upwardly and inwardly inclined with respect to said body, is slidably movable through said guide hole, and in conjunction with said single swing arm confines said upright holder to move upwardly and downwardly relative to said body without inclining said wheel.

7. A steerable vehicle toy, comprising:

a body having a wall portion;

a guide in said wall portion;

a steerable road wheel mounted on an axle, said axle having an axis;

an upwardly extending rod having an upper portion slidably guided in said guide;

a rotatable connection between a lower portion of said rod and said axle to permit steering rotation of said axle relative to said body during a steering operation;

a spring biassing said rod downwardly through said guide; and a single swing arm having two ends, one end being pivotally connected to said body, and the other end being pivotally connected to said lower portion of said rod, said ends having pivotal axes extending transverse to the axis of said axle;

said rod and said single swing arm guiding and constraining said wheel to move vertically with essentially no inclination of said wheel.

8. The vehicle toy of claim 7 wherein said rotatable connection comprises a support on which said axle is fixedly mounted, and said support is rotatably mounted on the lower portion of said rod.

9. The vehicle toy of claim 8, wherein said rod is slidable through said guide, and said rod is upwardly and inwardly inclined with respect to said body.

10. The vehicle toy of claim 8, wherein said rod extends upwardly through and beyond said guide and terminated in an enlarged head above said guide.

11. The vehicle toy of claim 8, wherein said spring is a compression spring surrounding said rod and interposed between said guide and said support.

12. The vehicle toy of claim 8, wherein said support is retained on said rod by a shoulder on said rod above said support and a stop on said rod below said support, said other end of said swing arm pivoting on said stop.

13. The vehicle toy of claim 8, wherein said support is retained on said rod between an upper shoulder and a lower stop on said rod, said other end of said swing arm pivoting on said stop.

14. The vehicle toy of claim 7, wherein said rod is upwardly and inwardly inclined with respect to said body, extends freely through and above said guide hole, and in conjunction with said single swing arm confines said wheel to move upwardly and downwardly relative to said body without inclining of said wheel.

15. The vehicle toy of claim 7, wherein said rod is upwardly and inwardly inclined with respect to said body.

16. The vehicle toy of claim 7, wherein said rod extends upwardly through said guide and terminates in an enlarged head above said guide, and said spring comprises a compression spring interposed between said guide and said rotatable connection.

17. The vehicle toy of claim 7, wherein said rotatable connection comprises an upright member on which said axle is fixedly mounted, and an upright holder rotatably supporting said upright member to permit rotation of said upright member during a steering operation.

18. The vehicle toy of claim 17, wherein said upright holder rotatably supports said upright member by means of a king pin, and said king pin is inclined upwardly and inwardly with respect to said body.

* * * * *

UNITED STATES PATENT AND TRADEMARK OFFICE

CERTIFICATE OF CORRECTION

PATENT NO. : 5,338,246

DATED : August 16, 1994

INVENTOR(S) : SUTO

It is certified that error appears in the above-identified patent and that said Letters Patent is hereby corrected as shown below:

In Claim 1: column 8, line 8,"form" should be --from--.

In Claim 5: column 8, line 30, "said guide wall" should be --said wall--.

In Claim 7: column 8, line 56, "vertically" should be --vertically upwardly--.

Signed and Sealed this

Twenty-eight Day of February, 1995

*Attest:*

Bruce Lehman

BRUCE LEHMAN

*Attesting Officer*

*Commissioner of Patents and Trademarks*